US005611887A

United States Patent [19]

Takenaka et al.

[11] Patent Number: 5,611,887

[45] Date of Patent: Mar. 18, 1997

[54] SINGLE FACER AND CORRUGATING ROLL FOR THE SAME

[75] Inventors: Hiroyuki Takenaka; Hiroaki Sasashige; Takayuki Miyake, all of Mihara, Japan

[73] Assignee: Mitsubishi Jukogyo Kabushiki Kaisha, Tokyo, Japan

[21] Appl. No.: 428,637

[22] Filed: Apr. 25, 1995

[30] Foreign Application Priority Data

May 13, 1994 [JP] Japan ..... 6-099441
Feb. 24, 1995 [JP] Japan ..... 7-036547

[51] Int. Cl.[6] ..... B31F 1/20; B31F 1/28

[52] U.S. Cl. ..... 156/472; 156/205; 156/210; 156/471; 156/553

[58] Field of Search ..... 156/472, 471, 156/210, 205, 209, 553, 555, 582; 493/463; 264/286; 425/336, 369; 428/179, 182; 162/111, 112

[56] References Cited

U.S. PATENT DOCUMENTS

| | | | |
|---|---|---|---|
| 3,053,309 | 9/1962 | Wilson et al. | 156/472 |
| 3,671,361 | 6/1972 | Morrison | 156/472 |
| 4,101,367 | 7/1978 | Maier | 156/472 |
| 4,188,253 | 2/1980 | Swartz | 156/472 |

FOREIGN PATENT DOCUMENTS

| | | |
|---|---|---|
| 577970 | 1/1994 | European Pat. Off. . |
| 2241657 | 3/1975 | France . |
| 2344401 | 10/1977 | France . |
| 58-96540 | 6/1983 | Japan . |
| 58-94514 | 6/1983 | Japan . |

*Primary Examiner*—Michele K. Yoder
*Attorney, Agent, or Firm*—Rothwell, Figg, Ernst & Kurz

[57] ABSTRACT

To provide a corrugating roll for a single facer which avoids generation of press marks or fracture of paper without a loss of paper by suppressing a contact pressure between a corrugating medium and a liner paper, and which may manufacture the corrugated paper in a low cost with easiness of machining work, in a corrugating roll for a single facer, in which a pair of corrugating rolls engage with each other through a tooth form in parallel to roll axes on circumferential surface portions of the rolls, a profile of a tooth tip portion is composed, in combination, of a plurality of arcs that are symmetrical with respect to a tooth apex portion. The profile of the tooth tip portion includes the tooth apex portion and is constituted in combination by a first arc having substantially the same radius of curvature as that of an outer circle of the corrugating roll. The profile of the tooth tip portion is constituted in combination by a second arc that inscribes with the first arc at a terminal portion of the first arc. The profile of the tooth tip portion is constituted in combination by a third arc that circumscribes with the second arc at a terminal portion of the second arc.

9 Claims, 7 Drawing Sheets d
h
g
e
A
A'
B
B
X
W
T
Y
Z
C
C
D
D
E
V
α
β
β
γ
γ
δ
RQ
OQ
RP
OP
OP
RC
OC
RB
OB

SINGLE FACER AND CORRUGATING ROLL FOR THE SAME

BACKGROUND OF THE INVENTION

The present invention relates to a single facer and a corrugating roll for a single facer.

An example of a conventional single facer (i.e., single faced corrugated board producing machine) is shown in FIG. 7. The single facer uses a pressure roll 3.

More specifically, a core paper 7 fed to the upper side of an upper corrugating roll 1 in a direction indicated by an arrow is delivered between a pair of an upper corrugating roll 1 and a lower corrugating roll 2. The upper corrugating roll 1 and the lower corrugating roll 2 have tooth forms in parallel with axes on circumferential portions thereof and are engaged with each other. The upper corrugating roll 1 and the lower corrugating roll 2 are rotated while the core paper 7 is fed in the engagement portion to thereby form the corrugation on the core paper 7.

The corrugated core paper 7 is transferred to a glue application roll 4 by the rotation of the lower corrugating roll 2. The glue application roll 4 performs the glue layer thickness control by a doctor roll 5, picks up glue contained within a glue container 6 and applies it to the top of the corrugation of the core paper 7.

The glue applied paper 7 is transferred to a pressure roll 3 by the rotation of the lower corrugating roll 2 and at the same time, a liner paper 8 is supplied to the pressure roll 3. The pressure roll 3 presses the liner paper 8 against the lower corrugating roll 2 and presses and adheres both papers to form a single-faced corrugated board 9.

Another example of the single facer is shown in FIG. 8. In this single facer, an endless pressure belt 10 is used instead of the pressure roll 3.

Since the pressure belt 10 simultaneously presses a plurality of teeth of the lower corrugating roll 2, it is possible to reduce a pressure between the core paper and the liner paper 8 in comparison with the pressure roll 3.

However, since the upper corrugating roll 1 and the lower corrugating roll 2 of the above-exemplified single facers have a tooth tip portion having a relatively small radius of curvature as shown in FIGS. 4 to 6, there have the following disadvantages.

More specifically, as shown in FIG. 4, the upper corrugating roll 1 and the lower corrugating roll 2 have the tooth portions in parallel to the roll axes on the roll outer circumferential portion of the radius $R_C$ of curvature. As shown in FIG. 5, their tooth profile of tooth portion is composed of three portions, i.e., a tooth tip portion, a tooth side portion and a tooth bottom portion.

The tooth tip portion includes a tooth apex portion $S_1$ and is defined by an arc ($S_1$ to $S_2$) forming a part of a circle $\epsilon$ (indicated by a two-dotted and dash line in FIG. 5) having a relatively small radius of curvature.

The tooth side portion is defined by a straight line ($S_2$ to $S_3$) that is tangential with the circle $\epsilon$ at a terminal portion of the arc ($S_1$ to $S_2$) forming the tooth tip portion.

The tooth bottom portion is tangential at a terminal end portion $S_3$ with the straight line ($S_2$ to $S_3$) forming the tooth side portion and is defined by a concave arc ($S_3$ to $S_4$) forming a part of a circle $\zeta$ (indicated by a two-dotted and dash line in FIG. 5) having a relatively small radius of curvature.

Thus, since the tooth tip portion of the lower corrugating roll 2 is defined by the arc ($S_1$ to $S_2$) having a relatively small radius of curvature, when the core paper 7 and the liner paper 8 are compressed between the lower corrugating roll 2 and the pressure roll 3 or the pressure belt 10, as shown in FIG. 6, a nip pressure W is applied between the tooth tip portion F of the lower corrugating roll 2 and the pressure roll 3 or the pressure belt 10, a pressure P having a sharp rise is applied to the paper E (i.e., the core paper 7 and the liner paper 8), and the maximum pressure is extremely increased.

If such a large local pressure is applied, not only a fracture of the paper is likely to be generated upon bonding but also a black pressure mark, called a press mark, is generated, to thereby permanent discoloring occurs even if the paper is not broken.

Accordingly, in the conventional corrugating roll, the paper fracture is very likely to occur upon bonding. Otherwise, the permanent discoloring, called a press mark, is generated to reduce a quality and a strength of the corrugated board. In addition, the conventional system has a disadvantage of generating a loss of paper to cause an economic problem. Also, a working efficiency is degraded.

Furthermore, in the above-described prior art, since the tooth tip portion has a relative small radius of curvature for the upper and lower corrugating rolls 1 and 2, it also has a disadvantage that the machining work is troublesome.

For example, upon machining the upper corrugating roll 1 and the lower corrugating roll 2, if, first of all, the roll form having a radius $R_C$ is machined and the tooth portion composed of the tooth tip portion, the tooth side portion and the tooth bottom portion in parallel to the roll axis on the roll outer circumferential portion, since the arc having the relatively small radius of curvature has to be formed as the tooth tip portion, the number of the machining steps is increased, as a result of which the manufacturing cost is increased.

SUMMARY OF THE INVENTION

In view of the above-described problems inherent in the prior art, it is an object of the invention to provide a corrugating roll for a single facer which avoids generation of press marks or fracture of paper without a loss of paper by suppressing a contact pressure between a corrugating medium and a liner paper, and it is another object of the invention to provide a corrugating roll for a single facer which may manufacture the corrugated paper in a low cost with easiness of machining work.

In order to attain these and other objects, according to the present invention, in a corrugating roll for a single facer, in which a pair of corrugating rolls engage with each other through a tooth form in parallel to roll axes on circumferential surface portions of the rolls, a profile of a tooth portion is composed, in combination, of a plurality of arcs that are symmetrical with respect to a tooth apex portion.

The profile of the tooth tip portion includes the tooth apex portion and is constituted in combination by a first arc having substantially the same radius of curvature as that of an outer circle of the corrugating roll. The profile of the tooth tip portion is constituted in combination by a second arc that inscribes with the first arc at a terminal portion of the first arc. The profile of the tooth tip portion is constituted in combination by a third arc that circumscribes with the second arc at a terminal portion of the second arc.

Also, it is preferable that a length of a chord which is a linear distance between the terminal portions of the first arc is 0.2 to 0.6 mm, more preferable, 0.35 to 0.4 mm.

According to the present invention, a pressure belt or a pressure roll is pressed against the corrugating roll, and a corrugating medium and a liner paper are fed between the corrugating roll and the pressure belt or the pressure roll to pressingly bond the corrugating medium and the liner paper together.

As described above in detail on the basis of the embodiment, according to the present invention, since the tooth tip portion of the corrugating roll is realized to have a gentle arc form that has no abrupt or steep change in the curvature, when the corrugating medium and the liner paper are compressed between pressure belt or pressure roll and the corrugating roll, the maximum contact pressure to the liner paper and the corrugating medium can be suppressed. Accordingly, it is possible to suppress the sharp rise and to make uniform the contact pressure between the pressing mechanism and the corrugating roll.

As a result, it is possible to suppress the fracture of the paper or the press mark that is the black pressure mark caused by the excessive pressure. It is therefore possible to avoid the loss of paper and to enhance the yield. It is possible to increase the strength and the quality of the corrugated board.

Also, even in the wave-shape formation by the engagement of the corrugating rolls, a smooth slippage is ensured. Therefore, the paper fracture due to the tension increment in formation may be prevented.

In addition, since the first arc of the tooth tip portion has the same radius of curvature as the radius of curvature of the outer circle of the corrugating roll, it is advantageous that the machining work is facilitated.

DESCRIPTION OF THE PREFERRED EMBODIMENTS

An embodiment of the invention will now be described in detail with reference to the accompanying drawings.

Figure 10:
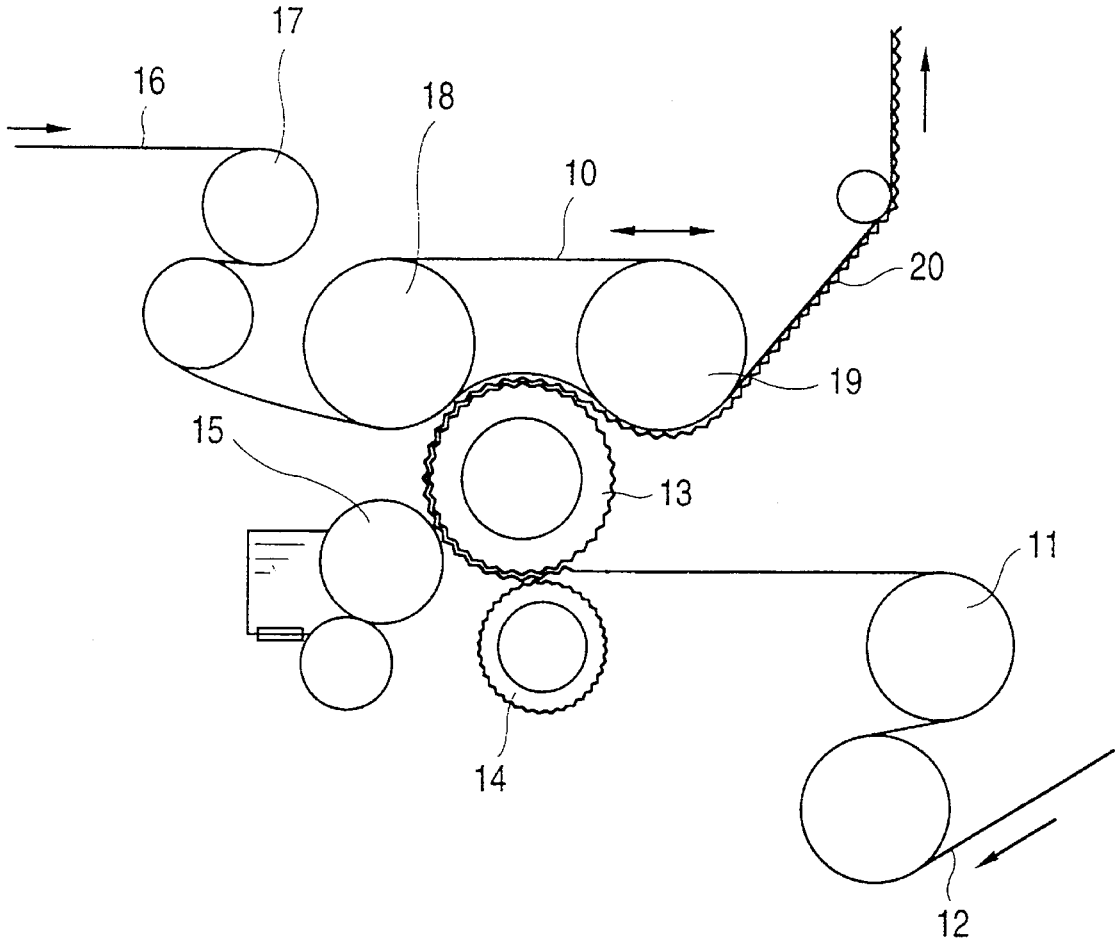
FIG. 10 is a view showing a structure of a single facer to which the invention is applied.

A single facer in accordance with the embodiment of the invention is shown in FIG. 10. In this embodiment, an endless pressure belt 10 is used.

More specifically, a corrugating medium 12 (i.e., core paper) that has been preheated through a preheat roll 11 is transferred between a pair of an upper corrugating roll 13 and a lower corrugating roll 14 in a direction indicated by an arrow. Each of the upper corrugating roll 13 and the lower corrugating roll 14 has a tooth form in parallel with an axis on a roll circumferential portion. Both rolls are engaged with each other. The upper corrugating roll 13 and the lower corrugating roll 14 are rotated and the corrugating medium is supplied to the engagement portion therebetween to thereby form the wave-shaped corrugation on the corrugating medium 12.

The corrugating medium 12 formed into the wave-shape is transferred to a glue application roll 15 by the rotation of the upper corrugating roll 13. The glue application roll 15 applies a glue to the corrugation apexes of the corrugating medium 12 after performing the glue layer thickness control.

The glue applied corrugating medium 12 is transferred to the pressure belt 10 by the rotation of the upper corrugating roll 13, and simultaneously is supplied with a liner paper 16 that has been preheated by a preheat roll 17.

The pressure belt 10 is an endless belt laid between belt rolls 18 and 19 and is adjusted so as to apply a constant pressure to the upper corrugating roll 13.

For this reason, the corrugating medium 12 and the liner paper 16 are supplied between the pressure belt 10 and the upper corrugating roll 13 so that both the corrugating medium and the liner paper are compressed and bonded to form a single-faced corrugated board 20.

Figure 1:
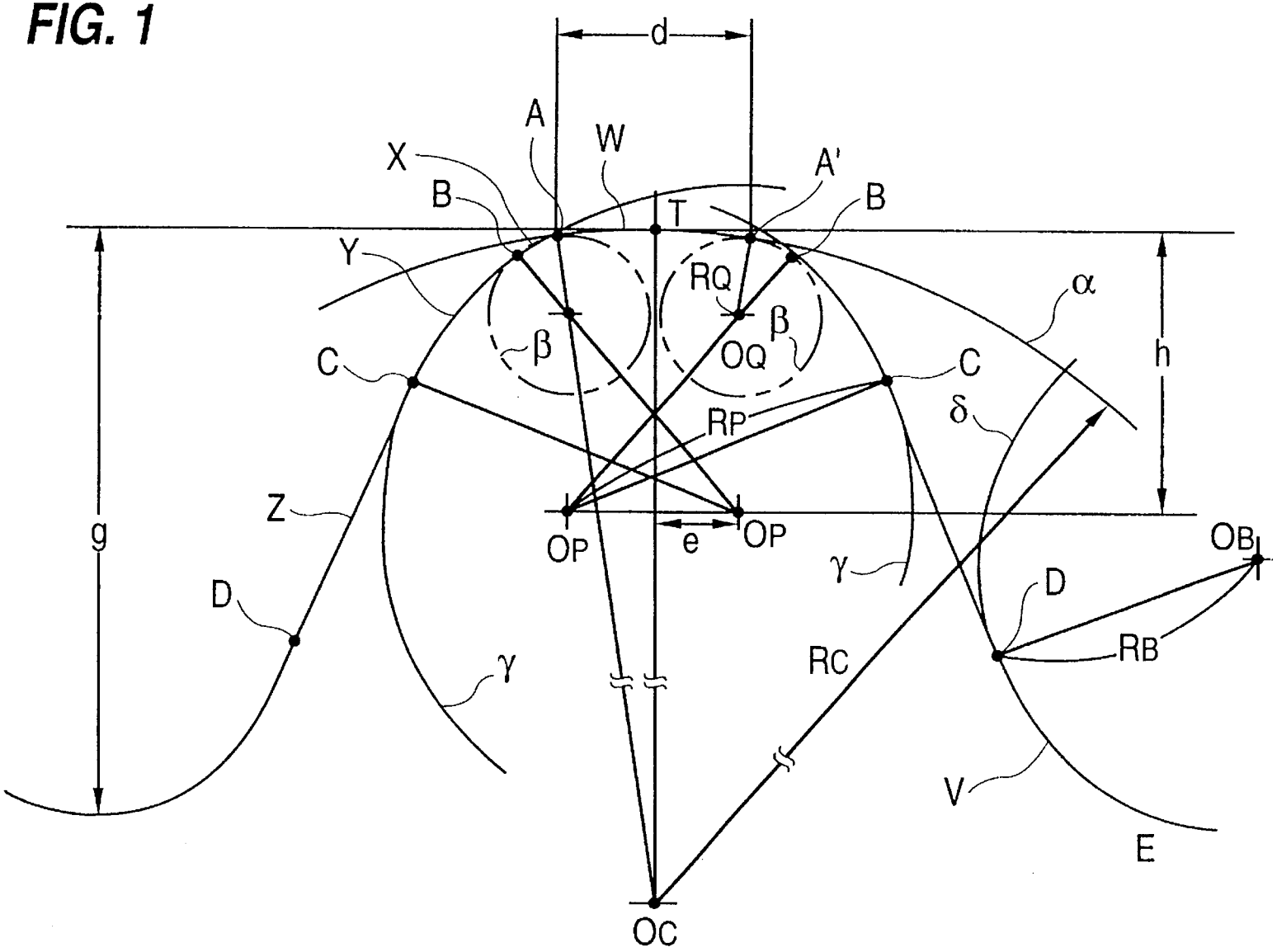
FIG. 1 is a side elevational view showing a corrugating roll tooth portion in accordance with an embodiment of the invention.

A tooth form profile of the upper corrugating roll 13 that is the corrugating roll is shown in FIG. 1. As shown in FIG. 1, the tooth form profile of the upper corrugating roll 13 is composed of a first arc W, a second arc X, a third arc Y, a straight line portion Z and a convex arc V.

The first arc W is formed by a part (A to A') of a circle $\alpha$ having a radius $R_C$ including a tooth apex portion T and a center about a corrugating roll center Oc. Accordingly, the radius of curvature of the first arc W is the same as the radius $R_C$ of curvature of an outer circle of the corrugating roll.

The second arc X is defined by a part (A to B) of an inscribing circle $\beta$ inscribing the circle $\alpha$ of the radius $R_C$ at a terminal portion A of the first arc W. The inscribing circle $\beta$ has a center $O_Q$ and a radius $R_Q$. Accordingly, the radius $R_Q$ of curvature of the second arc X is smaller than the radius $R_C$ of curvature of the first arc W.

The third arc Y is defined by a part (B to C) of a circumscribing circle $\gamma$ circumscribing the inscribing circle $\beta$ having a radius $R_Q$ from the outside at the terminal portion B of the second arc X. The circumscribing circle $\gamma$ has a center $O_P$ and a radius $R_P$. Accordingly, the radius $R_P$ of curvature of the third arc Y is larger than the radius $R_Q$ of curvature of the second arc X. However, the circumscribing circle $\gamma$ is smaller than the outer diameter of the corrugating roll. Namely, the relationship, $R_C>R_P>R_Q$, is established.

The profile of the tooth tip portion is defined by such a combination of the first arc W, the second arc X and the third arc Y.

The straight line portion Z is defined by a straight line (C to D) which is tangential with the outer tangential circle $\gamma$ at the terminal portion B of the third arc Y to form the tooth side portion.

The concave arc V is tangential at the terminal portion D with the straight line portion Z and is an arc forming a part of a circle δ having a radius $R_B$ having a center $O_B$. Unlike the fact that the centers $O_C$, $O_Q$ and $O_P$ of the circles α, β and γ are located inside of the tooth form profile, the center $O_B$ of the circle δ is located outside the tooth form profile.

For this reason, the concave arc V corresponds to a concave surface to form the tooth bottom portion of the tooth portion.

The first, second and third arcs W, X and Y, the straight line portion Z and the concave arc V are formed symmetrically with respect to a centerline connecting the tooth apex portion T and the center $O_C$ of the corrugating roll.

Since in the upper corrugating roll 13 according to the embodiment with such a structure, the first arc W of the tooth tip portion has the same radius of curvature as the curvature $R_C$ of curvature of the outer circle of the corrugating roll, it is advantageous that the machining work may be facilitated.

For example, upon machining the upper corrugating roll, it is sufficient that first of all, the roll form of radius $R_C$ is machined, and subsequently, the second arc X and the third arc Y are machined as the tooth tip portion in parallel to the roll axis on the roll outer circumferential portion. It is possible to omit the machining work for the first arc W. As a result, it is possible to decrease the manufacturing cost by omitting the machining step.

Such an advantage of reducing the number of the steps may be applied not only to the upper corrugating roll 13 but also to the lower corrugating roll 12.

Figure 3:
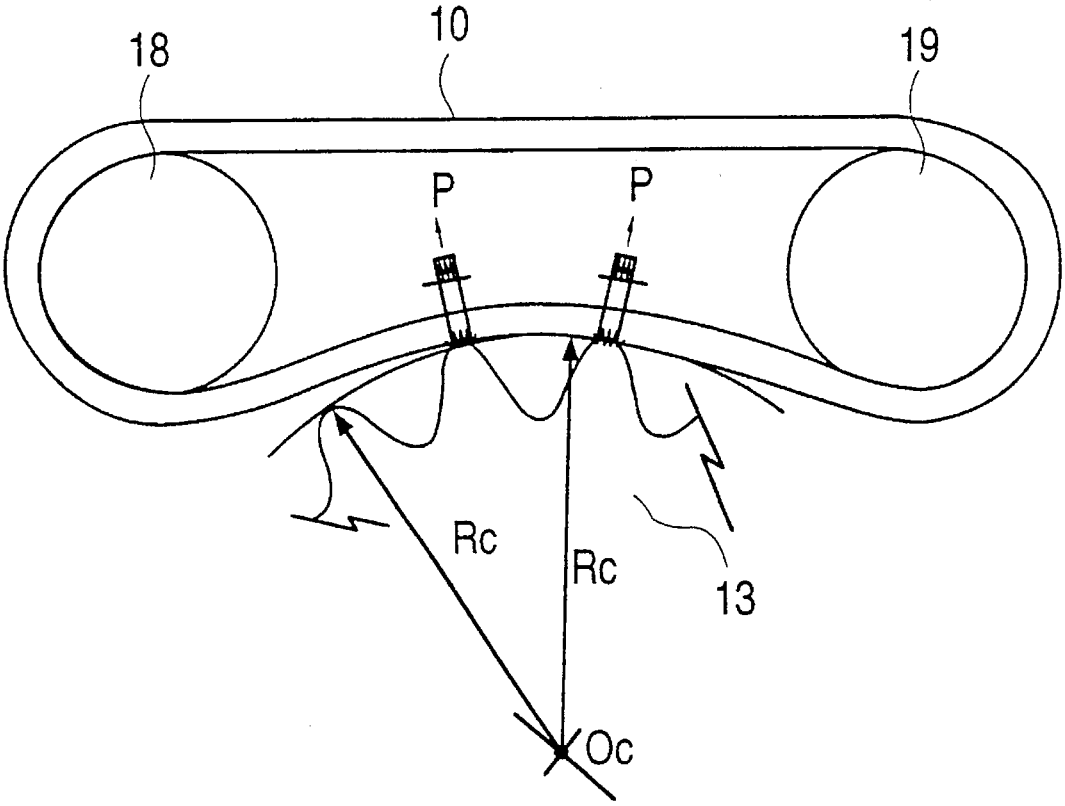
FIG. 3 is a side elevational cross-sectional view showing a pressure state of the corrugating roll in accordance with an embodiment of the invention.
Figure 4:
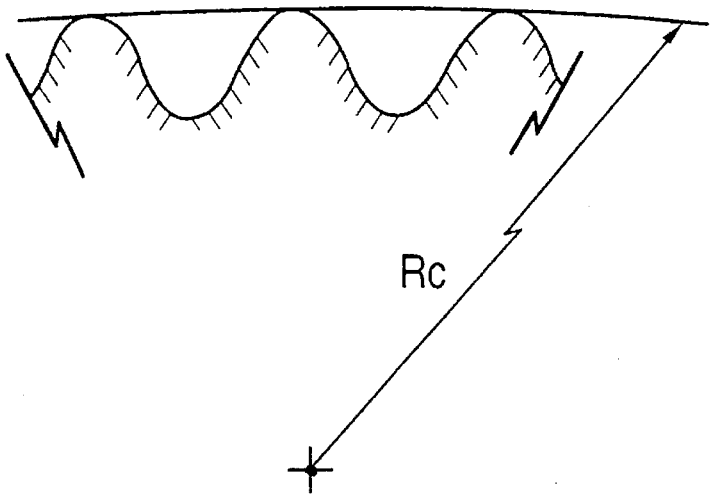
FIG. 4 (PRIOR ART)
FIG. 4 is a side elevational cross-sectional view showing a tooth portion of a conventional corrugating roll.
Figure 5:
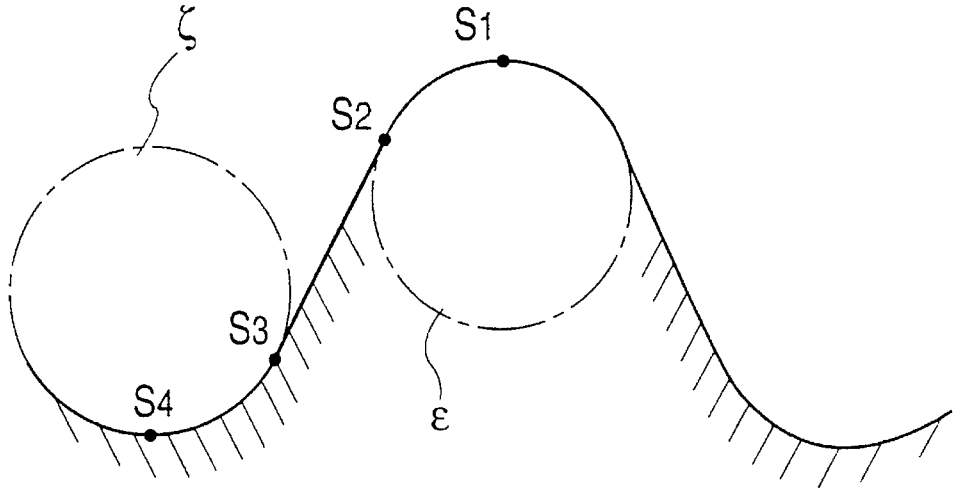
FIG. 5 (PRIOR ART)
FIG. 5 is an enlarged view of the tooth portion shown in FIG. 4.
Figure 6:
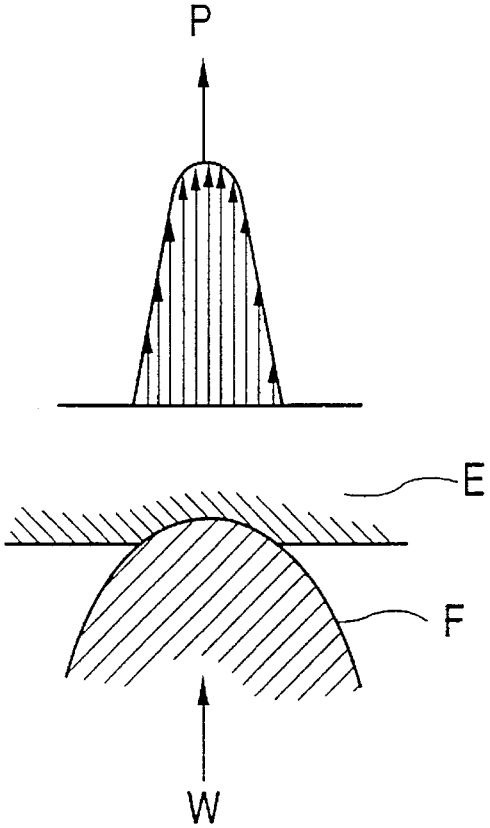
FIG. 6 (PRIOR ART)
FIG. 6 is an enlarged side elevational cross-sectional view showing a pressure state of the tooth portion against the paper shown in FIG. 5.

Also, as shown in FIG. 3, the upper corrugating roll 13 according to the embodiment is arranged so that a constant pressure P is applied to the pressure belt 10 upon bonding the corrugating medium 12 and the liner paper 16. Namely, the pressure belt 10 is wound so as to contact along the outer circumferential radius of curvature $R_C$ of the upper corrugating roll 13.

Since the first arc W that is the tooth tip portion of the upper corrugating roll 13 realizes a gentle arc having no abrupt change in the curvature, a pressure P is uniformly applied to the pressure belt 10 wound at the same radius $R_C$ of curvature as that of the outer circle of the corrugating roll so that a local pressure to cause a sharp rise would not be generated.

Figure 2:
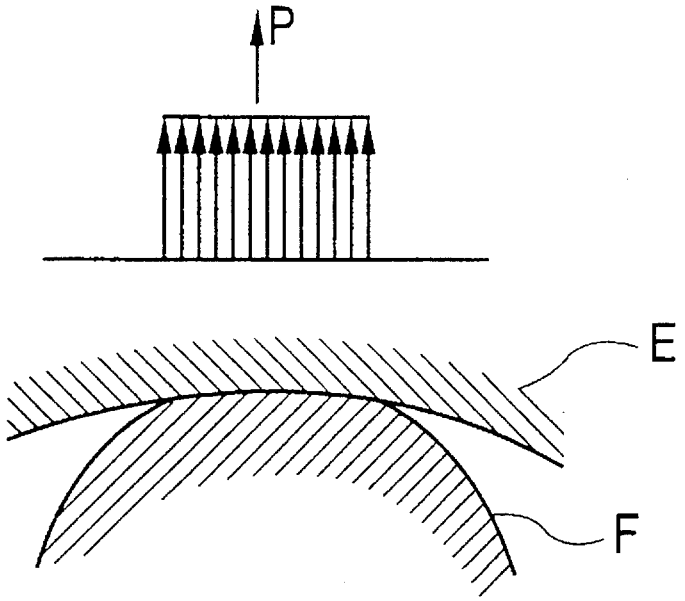
FIG. 2 is an enlarged side elevational cross-sectional view showing a pressure state of the corrugating roll against the paper in accordance with an embodiment of the invention.

Accordingly, when the corrugating medium 12 and the liner paper 16 are clamped between the upper corrugating roll 13 and the pressure belt 10, as shown in FIG. 2, a constant pressure P is applied uniformly also to the paper E (i.e., the corrugating medium 12 and the liner paper 16) from the tooth tip portion F of the upper corrugating roll 13. As a result, the fracture upon the bonding is prevented. Also, the black pressure mark called a press mark is not generated.

Numerical examples are shown in Table 1.

TABLE 1

| design factors: flute | | A flute | C flute | B flute |
|---|---|---|---|---|
| design factor | $R_C$: roll radius/radius of curvature of land | 200 | 200 | 200 |
| | $R_Q$: radius of curvature of the second arc | 0.70 | 0.65 | 0.50 |
| | $R_P$: radius of curvature of the third arc | 1.65 | 1.45 | 1.20 |
| | $R_H$: radius of curvature of the bottom arc | 1.95 | 1.75 | 1.50 |
| | h: distance between the center of the third arc and the corrugation apex portion | 1.45 | 1.40 | 1.20 |

TABLE 1-continued

| design factors: flute | A flute | C flute | B flute |
|---|---|---|---|
| e: eccentricity of third arc center | 0.01 | 0.01 | 0.01 |
| g: height of flute | 4.75 | 3.65 | 2.50 |
| z: number of flutes | 147 | 162 | 208 |
| d: land width | 0.45 | 0.4 | 0.35 |

The experiments were conducted as to various kinds of flutes of A flute, C flute and B flute shown in Table 1. As a result, it was confirmed that, as mentioned above, due to the uniformity of the pressure, the fracture was prevented and the black pressure mark was prevented.

Figure 9:
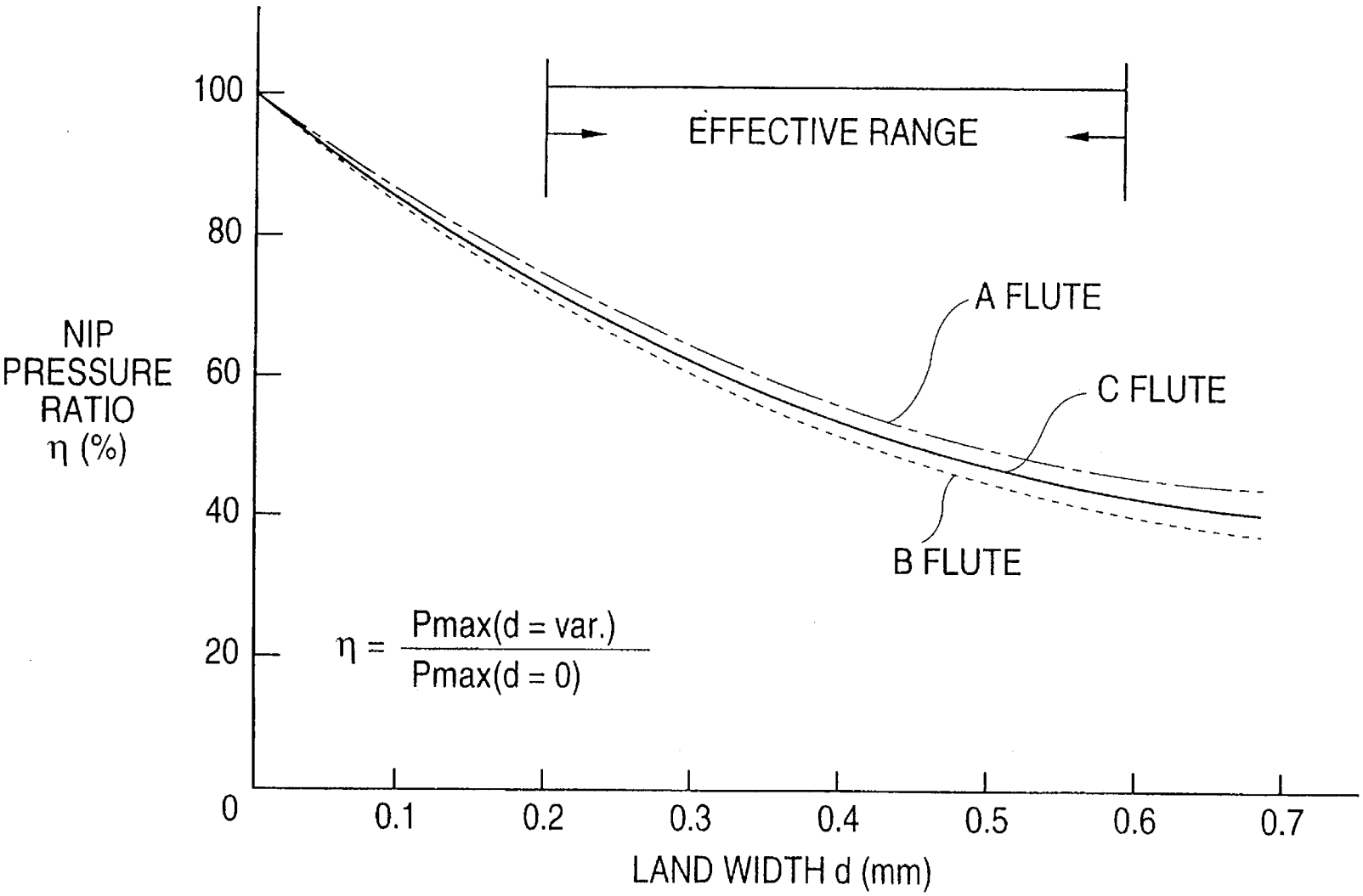
FIG. 9 is a graph showing a relationship between a land width and a nip pressure ratio.

Also, FIG. 9 shows the nip pressure ratio in the case where that the width d of the land of the first arc W was changed.

The land width d means the straight distance between the terminal A and the terminal A' of the first arc W, i.e., the length of the chord. Also, the nip pressure ratio η is indicated by a ratio of the nip pressure $P_{max}$ (d=variable) in the case where the land width d is widened with reference to the nip pressure $P_{max}$ (d=0) generated in the conventional trough form where the land width=0. The calculation of the nip pressure is conducted as follows. The maximum value of the contact pressure generated when each flute is pressed against the bonded paper (having a paper pressure 0.5 mm) composed of the corrugating medium and the liner paper at a pressure of 30 kg/cm was measured.

As is apparent from FIG. 9, as the land width d is increased, the nip pressure ratio η is decreased. In the decreasing effect in this case, almost no difference occurs in accordance with the kind of flutes. Also, it should be understood that even if the land width d is unduly increased, the effect is not so much improved.

Accordingly, the effective range of the land width is from d=0.2 mm at which the large effect is ensured with a slight change of the land width d (η≈75%) to d=0.6 mm at which the effect is not remarkable even if the land width is increased to exceed the limit (η≈about 40%). More preferably, the land width is in the range of d=0.35 to 0.40.

Figure 7:
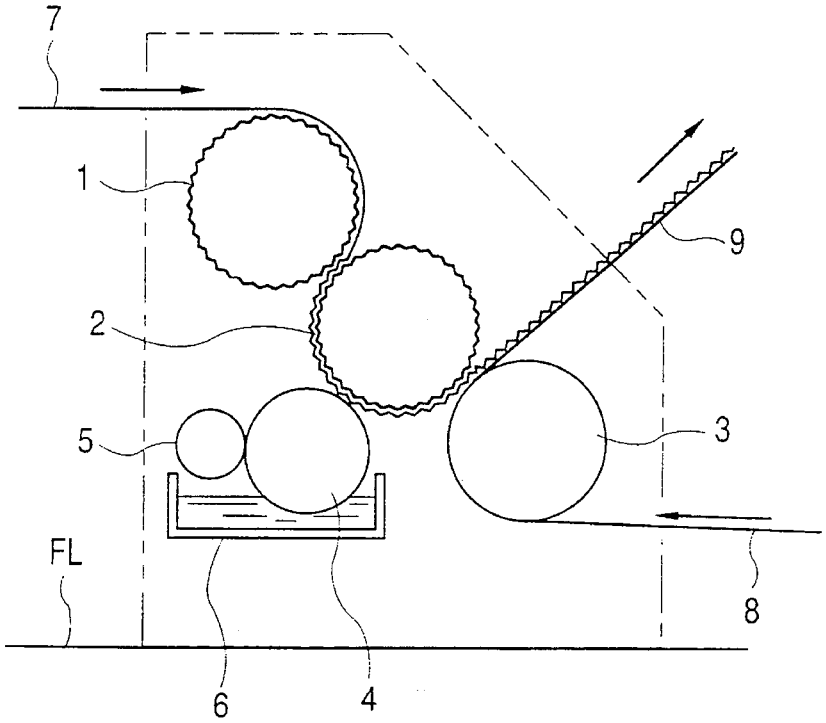
FIG. 7 (PRIOR ART)
FIG. 7 is a schematic side elevational cross-sectional view showing a first example of a conventional single facer.
Figure 8:
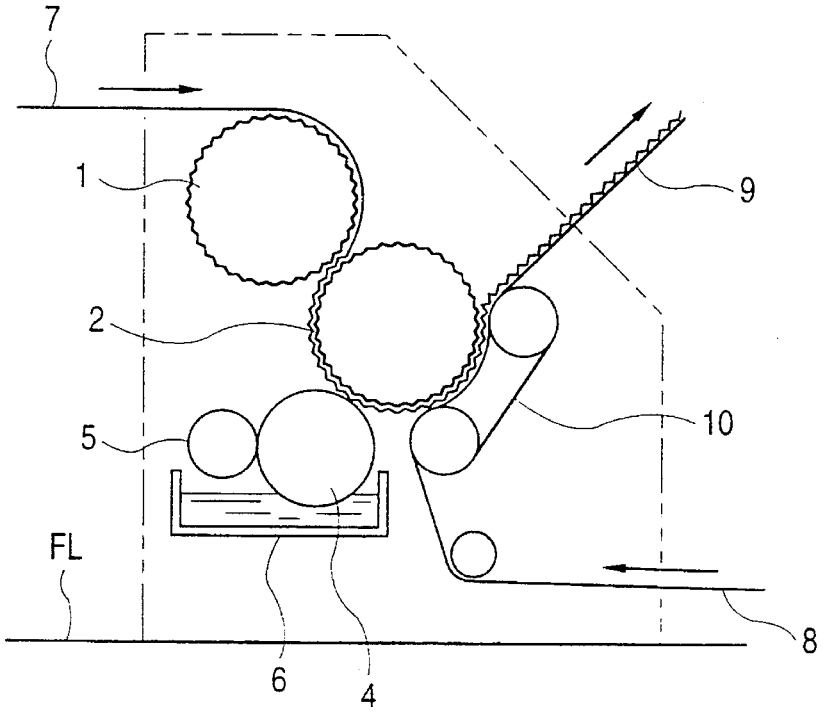
FIG. 8 (PRIOR ART)
FIG. 8 is a schematic side elevational cross-sectional view showing a second example of a conventional single facer.

Incidentally, in the embodiment, the pressure belt 10 is used as a pressing mechanism. In the case where, instead of the pressure belt, the pressure roll 3 shown in FIG. 7 is used, it is possible to apply a constant contact pressure uniformly substantially in the same manner as in the embodiment due to the effect obtained by reducing the curvature of the first arc W.

Also, the paper fracture phenomenon of the liner paper or the corrugation paper which was sometimes suffered due to the excessive vibration caused at the resonant speed in the operation is remarkably improved.

Incidentally, needless to say, the first arc W may include, of course, the same curvature as that of the outer diameter of the corrugating roll and the similar curvature. The straight line portion Z may also be modified to the similar curve.

As described above in detail on the basis of the embodiment, according to the present invention, the gentle arc form has no abrupt or steep change in the curvature in the tooth tip portion of the corrugating roll. Accordingly, it is possible to make uniform the contact pressure between the pressing mechanism and the corrugating roll. As a result, it is possible to suppress the fracture of the paper or the press mark which is the black pressure mark caused by the excessive pressure. It is therefore possible to avoid the loss of paper and to enhance the yield. It is possible to increase the strength and the quality of the corrugated board. Also, even in the wave-shape formation by the engagement of the corrugating rolls, a smooth slippage is ensured. Therefore, the paper fracture due to the tension increment in formation may be prevented. In addition, since the first arc of the tooth tip portion has the same radius of curvature as the radius of curvature of the outer circle of the corrugating roll, it is advantageous that the machining work is facilitated. Incidentally, the corrugating roll may be used in combination with the pressure roll or with the pressure belt.

What is claimed is:

1. A corrugating apparatus for a single facer, comprising a pair of corrugating rolls which engage with each other through a tooth form in parallel to roll axes on circumferential surface portions of the rolls, wherein each tooth form of one of said corrugating rolls is defined by a first convex arc having substantially the same radius of curvature as that of an outer circle of said corrugating roll in a cross section perpendicular to an axis of said corrugating roll; and each tooth form is formed symmetrically with a tooth apex portion, said tooth form including a tooth tip portion having a cross-sectional form defined by a second arc extending from and inscribing with the first arc at a terminal portion of the first arc and a third arc extending from and circumscribing with the second arc at a terminal portion of the second arc, a straight portion extending as a tangential line contacting at a terminal portion of said third arc, and a tooth bottom portion defined by a concave arc contacting at a terminal portion of said straight line portion.

2. A corrugating apparatus according to claim 1, wherein a length of a chord which is a linear distance between terminal portions of the first arc is 0.2 to 0.6 mm.

3. A corrugating apparatus according to claim 2, wherein a length of a chord which is a linear distance between the terminal portions of the first arc is 0.35 to 0.4 mm.

4. A corrugating apparatus according to claim 2, wherein a pressure roll is pressed against said corrugating roll, and a corrugating medium and a liner paper are fed between said corrugating roll and said pressure roll to pressingly bond the corrugating medium and the liner paper together.

5. A corrugating apparatus according to claim 3, wherein a pressure roll is pressed against said corrugating roll, and a corrugating medium and a liner paper are fed between said corrugating roll and said pressure roll to pressingly bond the corrugating medium and the liner paper together.

6. A corrugating apparatus according to claim 1, wherein a pressure roll is pressed against said corrugating roll, and a corrugating medium and a liner paper are fed between said corrugating roll and said pressure roll to pressingly bond the corrugating medium and the liner paper together.

7. A corrugating apparatus according to claim 2, wherein a pressure belt is pressed against said corrugating roll, and a corrugating medium and a liner paper are fed between said corrugating roll and said pressure belt to pressingly bond the corrugating medium and the liner paper together.

8. A corrugating apparatus according to claim 3, wherein a pressure belt is pressed against said corrugating roll, and a corrugating medium and a liner paper are fed between said corrugating roll and said pressure belt to pressingly bond the corrugating medium and the liner paper together.

9. A corrugating apparatus according to claim 1, wherein a pressure belt is pressed against said corrugating roll, and a corrugating medium and a liner paper are fed between said corrugating roll and said pressure belt to pressingly bond the corrugating medium and the liner paper together.

* * * * *